US011776439B2

(12) United States Patent
Min et al.

(10) Patent No.: US 11,776,439 B2
(45) Date of Patent: Oct. 3, 2023

(54) DISPLAY DRIVER INCLUDING CRACK RESISTANCE MEASUREMENT CIRCUIT AND METHOD OF MEASURING CRACK OF DISPLAY PANEL

(71) Applicant: LX SEMICON CO., LTD., Daejeon (KR)

(72) Inventors: Chang Gi Min, Daejeon (KR); Young Tae Kim, Daejeon (KR); Seung Oh Ko, Daejeon (KR); Young Bok Kim, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/567,509

(22) Filed: Jan. 3, 2022

(65) Prior Publication Data

US 2022/0215783 A1 Jul. 7, 2022

(30) Foreign Application Priority Data

Jan. 5, 2021 (KR) ..... 10-2021-0000754

(51) Int. Cl.
*G09G 3/00* (2006.01)

(52) U.S. Cl.
CPC ..... *G09G 3/006* (2013.01); *G09G 3/035* (2020.08); *G09G 2330/12* (2013.01)

(58) Field of Classification Search
CPC ..... G09G 3/006; G09G 2330/12; G09G 3/035
See application file for complete search history.

(56) References Cited

U.S. PATENT DOCUMENTS

2005/0270198 A1 12/2005 Hehn
2018/0053455 A1 2/2018 Zhang et al.
2018/0174505 A1* 6/2018 Mandlik ..... H01L 27/3276
2020/0111395 A1* 4/2020 Kang ..... G09G 3/3225

FOREIGN PATENT DOCUMENTS

KR 10-2017-0033966 A 3/2017

* cited by examiner

*Primary Examiner* — Hang Lin
(74) *Attorney, Agent, or Firm* — Hyunho Park

(57) ABSTRACT

A display driver including a crack resistance measurement circuit according to one embodiment of the present disclosure includes a crack resistance measurement circuit connected to a crack resistance circuit of a display panel to measure a crack resistance of the crack resistance circuit, wherein the crack resistance measurement circuit includes a reference resistance generation circuit configured to generate a reference resistance using at least two resistors connected in series and at least two switches connected to correspond to the at least two resistors, a comparator configured to compare a magnitude of the crack resistance with a magnitude of the reference resistance and output a resistance comparison result, and a circuit controller configured to output a reference resistance control signal for controlling the at least two switches according to the resistance comparison result.

18 Claims, 6 Drawing Sheets

DISPLAY DRIVER INCLUDING CRACK RESISTANCE MEASUREMENT CIRCUIT AND METHOD OF MEASURING CRACK OF DISPLAY PANEL

CROSS-REFERENCE TO RELATED APPLICATIONS

This application claims the benefit of the Korean Patent Applications No. 10-2021-0000754 filed on Jan. 5, 2021 which is hereby incorporated by reference as if fully set forth herein.

FIELD

The present disclosure relates to a display driver including a crack resistance measurement circuit and a method of measuring a crack of a display panel.

BACKGROUND

Along with the development of display technologies, flexible displays, transparent display panels, and the like are being developed. A flexible display refers to a bendable display device.

A flexible display includes a plastic film instead of a glass substrate surrounding liquid crystals in the conventional liquid crystal display (LCD) and organic light-emitting diode (OLED), and thereby, the flexible display has flexibility to be foldable or unfoldable.

The flexible display is not only thin and light but also is highly resistant to an impact. Furthermore, the flexible display may be foldable and bendable and may be manufactured into various shapes. In particular, the flexible display may be applied to industrial fields to which the conventional glass substrate-based display has been applied restrictively or has not even been applicable.

However, as such a flexible display is bent, there may be a problem in that cracks occur

SUMMARY

Accordingly, the present disclosure is directed to providing a display driver including a crack resistance measurement circuit, which is capable of measuring a resistance of a display panel to detect a defect due to a crack occurring in the display panel, and a method of measuring a crack of a display panel.

A display device including a crack resistance measurement circuit according to one embodiment of the present disclosure includes a crack resistance measurement circuit connected to a crack resistance circuit of a display panel to measure a crack resistance of the crack resistance circuit, wherein the crack resistance measurement circuit includes a reference resistance generation circuit configured to generate a reference resistance using at least two resistors connected in series and at least two switches connected to correspond to the at least two resistors, a comparator configured to compare a magnitude of the crack resistance with a magnitude of the reference resistance and output a resistance comparison result, and a circuit controller configured to output a reference resistance control signal for controlling the at least two switches according to the resistance comparison result.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
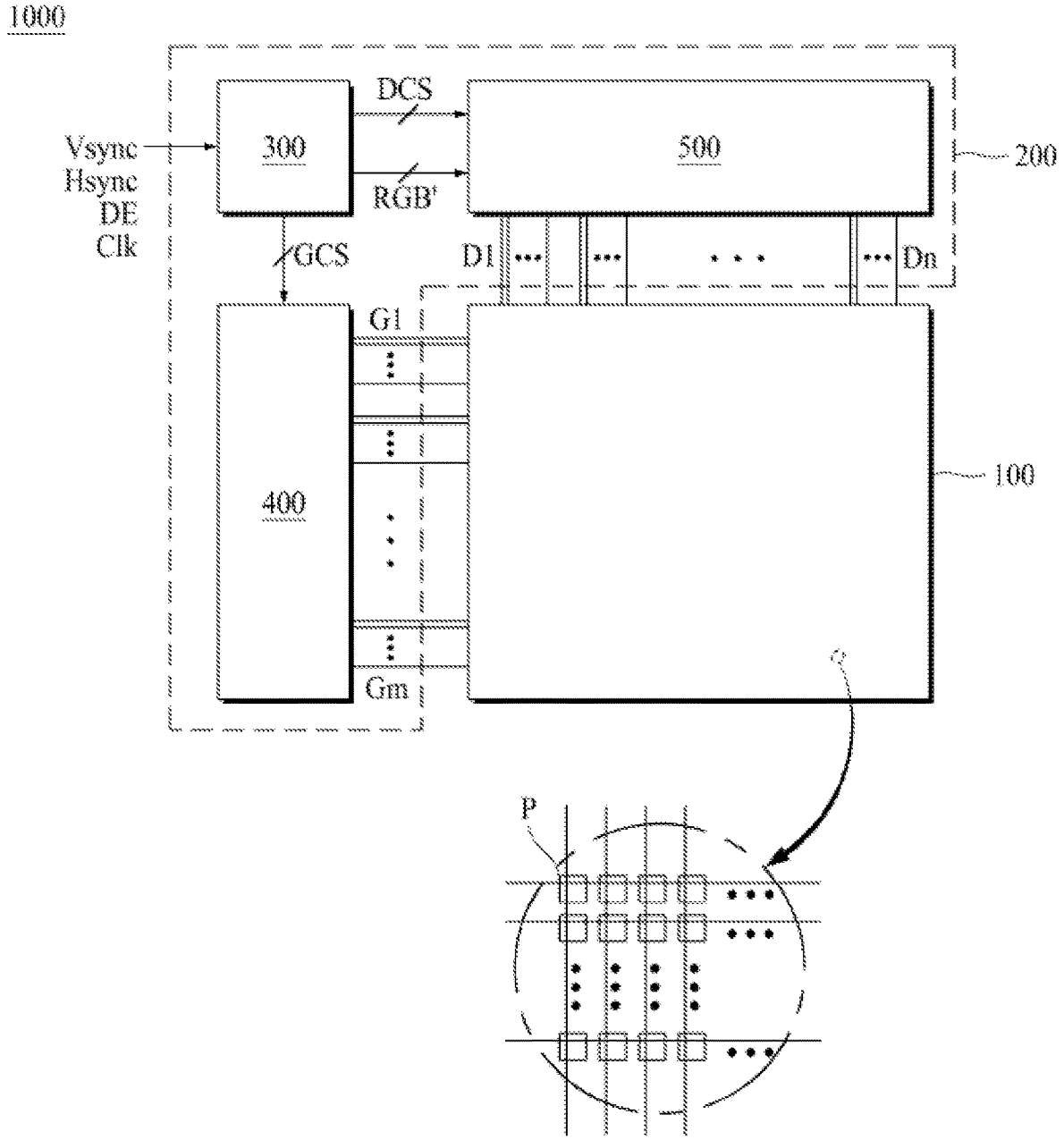
FIG. 1 is a block diagram of a display device according to one embodiment of the present disclosure.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only' is used. The terms of a singular form may include plural forms unless referred to the contrary.

In construing an element, the element is construed as including an error range although there is no explicit description.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, a display device according to the present disclosure will be described in detail with reference to FIGS. 1 and 2.

Figure 2:
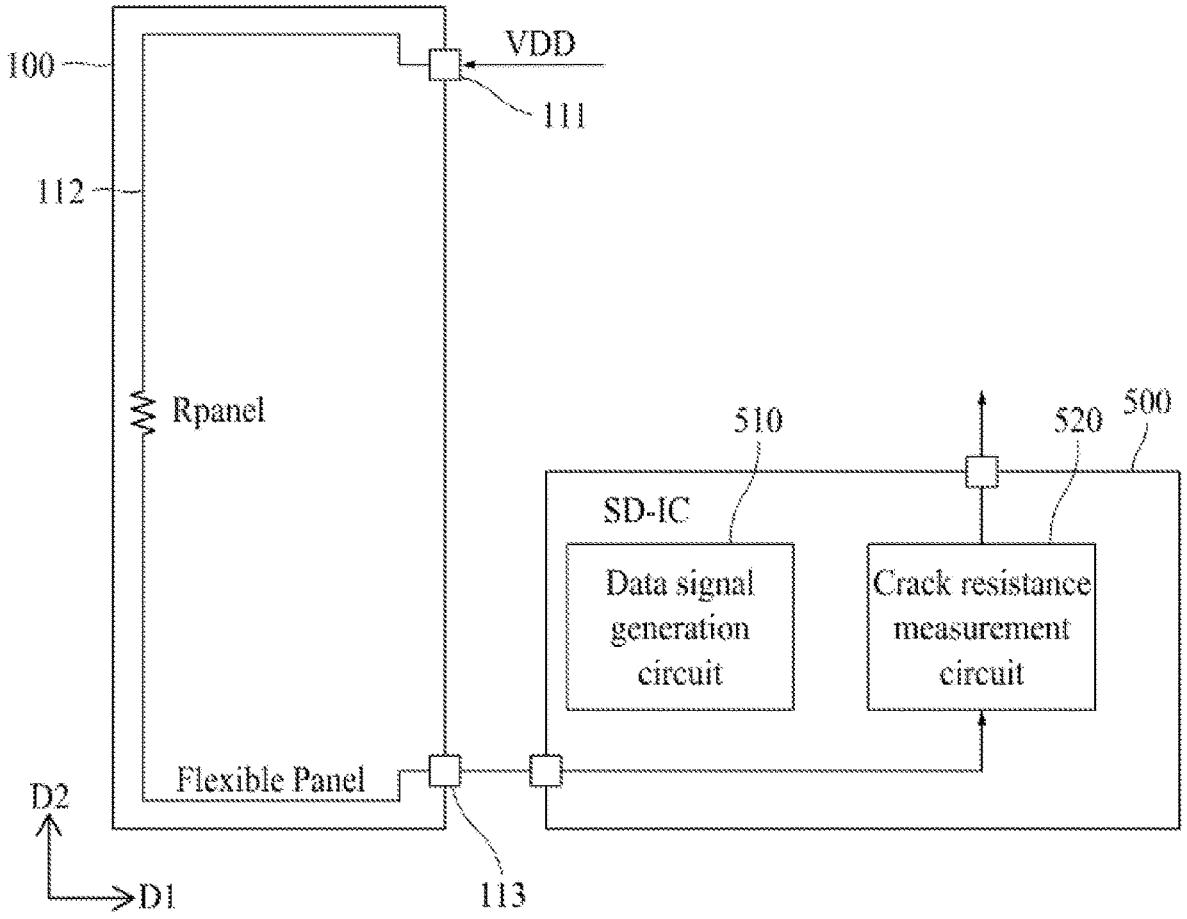
FIG. 2 is a block diagram of a data drive integrated circuit according to one embodiment of the present disclosure.

FIG. 1 is a block diagram of the display device according to one embodiment of the present disclosure, and FIG. 2 is a diagram illustrating a connection relationship between a display panel and a crack resistance measurement circuit according to one embodiment of the present disclosure.

Referring to FIG. 1, a display device 1000 according to one embodiment of the present disclosure includes a display panel 100 and a display driver 200.

The display device 1000 may include a flexible display panel and may include one or more thin film transistors (TFTs) and organic light-emitting diodes (OLEDs), but the present disclosure is not limited thereto. In addition to an OLED display, the display device 1000 may be implemented as another display such as a liquid crystal display, a field emission display, an electroluminescence display, or an electrophoretic display.

The display panel 100 includes a plurality of gate lines G1 to Gm, a plurality of data lines D1 to Dn, and a plurality of pixels P.

Each of the plurality of gate lines G1 to Gm receives a scan pulse during a display period (DP). Each of the plurality of data lines D1 to Dn receives a data signal during the DP. The plurality of gate lines G1 to Gm and the plurality of data lines D1 to Dn are positioned to intersect each other on a substrate to define a plurality of pixel areas. Each of the plurality of pixels P may include a TFT (not shown) connected to an adjacent gate line and an adjacent data line, a pixel electrode (not shown) connected to the TFT, and a storage capacitor (not shown) connected to the pixel electrode.

According to one embodiment of the present disclosure, the display panel 100 may include a crack resistance circuit. As shown in FIG. 2, the crack resistance circuit includes a first pad part 111, a crack resistance Rpanel, a crack resistance line 112, and a second pad part 113.

The first pad part 111 receives a first voltage VDD from a power supply. The first pad part 111 may be positioned at one end of the display panel 100.

A magnitude of the crack resistance Rpanel is measured by a crack resistance measurement circuit 520 to be described below.

The crack resistance line 112 may be disposed along an edge of the display panel 100. Specifically, according to one embodiment of the present disclosure, the display panel 100 has a rectangular shape extending in a first direction D1 and a second direction D2 and has four edges extending in the first direction D1 and the second direction D2. The crack resistance line 112 may be positioned along at least one of one edge of the display panel 100 extending in the first direction D1 and one edge of the display panel 100 extending in the second direction D2. Accordingly, by measuring the magnitude of the crack resistance Rpanel of the crack resistance circuit, it is possible to measure whether a crack occurs in the display panel 100 in the first direction D1 and the second direction D2.

The second pad part 113 is connected to the crack resistance measurement circuit 520 of a data driver 500. The second pad part 113 may be positioned at the other end of the display panel 100. Although the first pad part 111 and the second pad part 113 are illustrated in FIG. 2 as being positioned at different corners, the present disclosure is not limited thereto, and the first pad part 111 and the second pad part 113 may be positioned at one corner of the display panel 100.

The display driver 200 allows data signals to be supplied to the plurality of pixels P included in the display panel 100, thereby allowing an image to be displayed through the display panel 100.

The display driver 200 includes a timing controller 300, a gate driver 400, and the data driver 500.

The timing controller 300 receives various timing signals including a vertical synchronization signal Vsync, a horizontal synchronization signal Hsync, a data enable (DE) signal, and a clock signal Clk from an external system (not shown) and generates a gate control signal (GCS) for controlling the gate driver 400 and a data control signal (DCS) for controlling the data driver 500. In addition, the timing controller 300 receives an image signal RGB from the external system and converts the received image signal RGB into an image signal RGB' in a form processable by the data driver 500 to output the image signal RGB'.

A host system converts digital image data into data in a format suitable to be displayed on the display panel 100. The host system transmits timing signals together with digital image data to the timing controller 300. The host system is implemented as any one of a television system, a set-top box, a navigation system, a digital versatile disc (DVD) player, a Blu-ray player, a personal computer (PC), a home theater system, and a phone system to receive an input image.

The gate driver 400 receives the GCS from the timing controller 300. The GCS may include a gate start pulse (GSP), a gate shift clock (GSC), a gate output enable signal, and the like. The gate driver 400 generates gate pulses (scan pulses) synchronized with a data signal through the received GCS and shifts the generated gate pulses to sequentially supply the gate pulses to the gate lines G1 to Gm. To this end, the gate driver 400 may include a plurality of gate drive integrated circuits (ICs) (not shown). The gate drive ICs sequentially supply the gate pulses synchronized with the data signal to the gate lines G1 to Gm under control of the timing controller 300 to select data lines to which the data signal is applied. The gate pulse swings between a gate high voltage and a gate low voltage.

According to one embodiment of the present disclosure, as shown in FIG. 2, the data driver 500 includes a data signal generation circuit 510 and the crack resistance measurement circuit 520.

The data signal generation circuit 510 receives the DCS and the image signal RGB' from the timing controller 300. The DCS may include a source start pulse (SSP), a source sampling clock (SSC), and a source output enable (SOE) signal. The SSP controls a data sampling start timing of n source drive ICs (not shown) constituting the data driver 500. The SSC is a clock signal that controls a data sampling timing in each of the source drive ICs. The SOE signal controls an output timing of each source drive IC.

In addition, the data signal generation circuit 510 converts the received image signal RGB' into an analog data signal and supplies the analog data signal to the pixels P through the plurality of data lines D1 to Dn.

The crack resistance measurement circuit 520 is connected to the crack resistance circuit of the display panel 100 through the second pad part 113 to measure the crack resistance Rpanel of the crack resistance circuit. The crack resistance measurement circuit 520 may measure the crack resistance Rpanel of the crack resistance circuit to determine whether a crack has occurred in the display panel 100.

The crack resistance measurement circuit 520 according to one embodiment of the present disclosure will be described below in detail with reference to FIGS. 3 and 4.

Hereinafter, the crack resistance measurement circuit according to one embodiment of the present disclosure will be described in detail with reference to FIGS. 3 and 4. FIG. 3 is a block diagram of the crack resistance measurement circuit according to one embodiment of the present disclosure, and FIG. 4 is a circuit diagram of a reference resistance generation circuit according to one embodiment of the present disclosure.

The crack resistance measurement circuit 520 measures a magnitude of a measured resistance. Specifically, as described above, the crack resistance measurement circuit 520 is connected to the crack resistance circuit of the display panel 100 to measure a magnitude of the crack resistance Rpanel of the crack resistance circuit. According to one embodiment of the present disclosure, whether a defect due to a crack occurs in the display panel 100 may be determined using the magnitude of the crack resistance Rpanel measured through the crack resistance measurement circuit 520.

Figure 3:
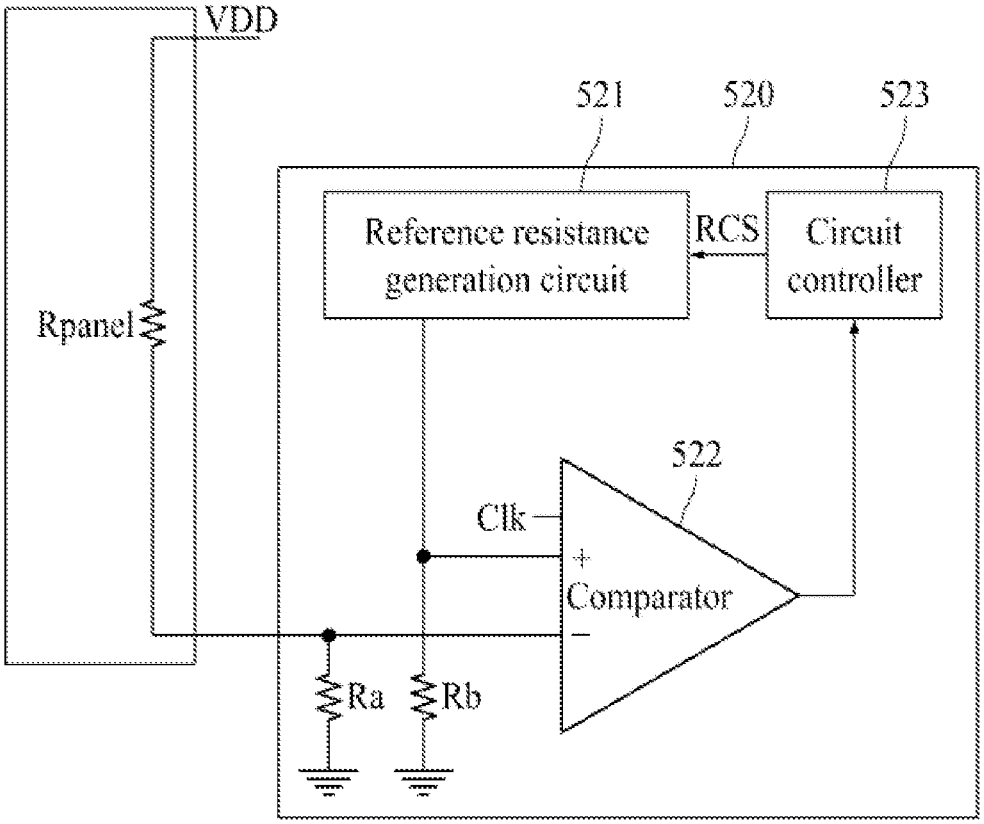
FIG. 3 is a block diagram of a crack resistance measurement circuit according to one embodiment of the present disclosure.

Referring to FIG. 3, the crack resistance measurement circuit 520 includes a reference resistance generation circuit 521, a comparator 522, and a circuit controller 523.

The reference resistance generation circuit 521 generates a reference resistance Rref to be compared with a measured resistance. Specifically, the reference resistance generation circuit 521 generates the reference resistance Rref for comparison with the crack resistance Rpanel to be measured.

Figure 4:
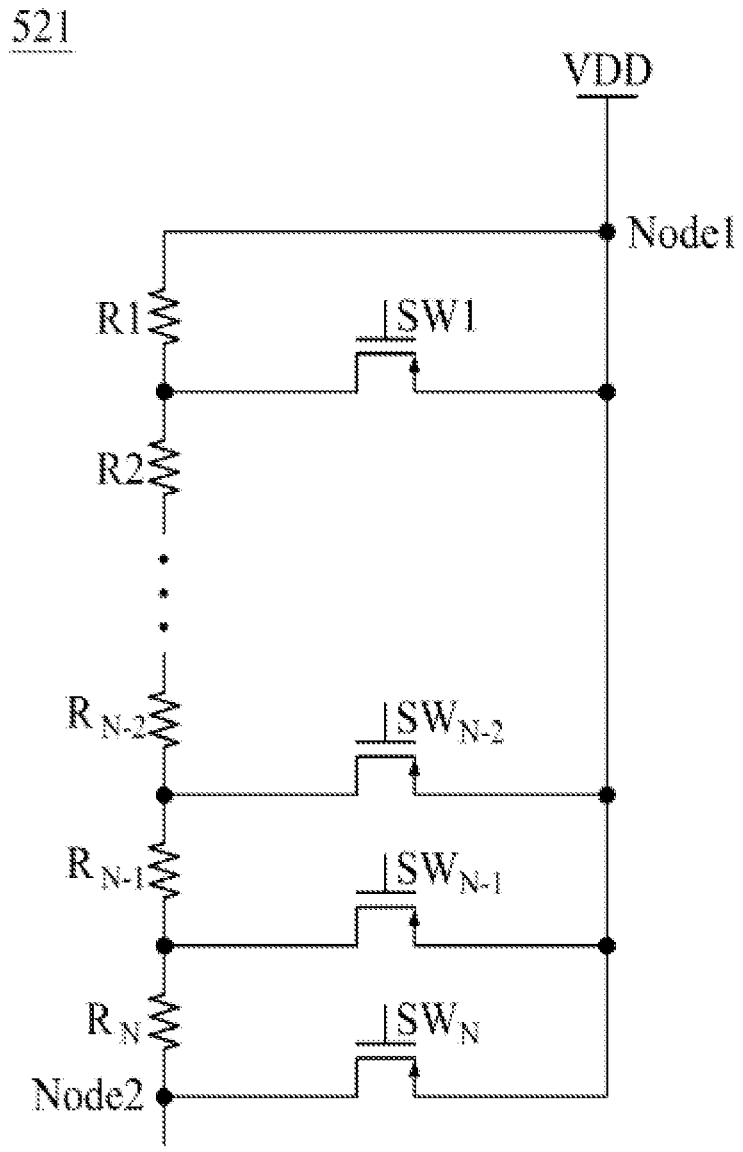
FIG. 4 is a circuit diagram of a reference resistance generation circuit according to one embodiment of the present disclosure.

Referring to FIG. 4, the reference resistance generation circuit 521 may include a plurality of resistors and may generate the reference resistance Rref by combining the plurality of resistors according to a signal from the circuit controller 523 to be described below. Specifically, the reference resistance generation circuit 521 includes first to $N^{th}$ resistors $R_1$ to $R_N$ and first to $N^{th}$ switches $SW_1$ to $SW_N$ corresponding to the respective resistors.

The first to $N^{th}$ resistors $R_1$ to $R_N$ are connected in series between an input node Node1 and an output node Node2, and the first to $N^{th}$ switches $SW_1$ to $SW_N$ are positioned between the input node Node1 and the output node Node2 to be parallel with corresponding resistors. Accordingly, the reference resistance Rref may be generated according to the resistors connected under control of the first to $N^{th}$ switches $SW_1$ to $SW_N$. That is, each of the first to $N^{th}$ switches $SW_1$ to $SW_N$ is turned on or off by receiving a reference resistance control signal RCS from the circuit controller 523, thereby controlling a magnitude of the reference resistance Ref generated by the reference resistance generation circuit 521.

The first to $N^{th}$ resistors $R_1$ to $R_N$ may be resistors having the same resistance. A resistance of each of the first to $N^{th}$ resistors $R_1$ to $R_N$ may be the same as a resolution of the reference resistance Rref generated by the reference resistance generation circuit 521. In addition, the reference resistance Rref generated by the reference resistance generation circuit 521 may be a resistance having a value within an expected crack resistance range of zero to the product of a resistance value of each of the first to $N^{th}$ resistors $R_1$ to $R_N$ and the total number (N) of the resistors. For example, each of the first to $N^{th}$ resistors $R_1$ to $R_N$ may have a resistance of 1 kΩ, and thus, the reference resistance generation circuit 521 may have a resolution of 1 kΩ, and the reference resistance Rref may be in an expected crack resistance range of zero Ω to N×1 kΩ. In this case, the expected crack resistance range indicates a range that is expected to include a value of the crack resistance Rpanel. According to one embodiment of the present disclosure, the expected crack resistance range may be reduced by half according to a clock signal.

According to the present disclosure, a crack resistance can be measured more accurately by improving the resolution of the crack resistance measurement circuit.

The comparator 522 compares a measured resistance with the reference resistance Rref of the reference resistance generation circuit 521. Specifically, according to one embodiment of the present disclosure, the comparator 522 compares the crack resistance Rpanel of the display panel 100 with the reference resistance Rref of the reference resistance generation circuit 521 and outputs a resistance comparison result.

According to one embodiment of the present disclosure, the comparator 522 compares the crack resistance Rpanel of the display panel 100 with the reference resistance Rref of the reference resistance generation circuit 521 according to the clock signal Clk output from the timing controller 300.

The circuit controller 523 supplies a signal for controlling a magnitude of the reference resistance Rref to the reference resistance generation circuit 521. Specifically, in order to control the magnitude of the reference resistance Rref according to a comparison result by the comparator 522, the circuit controller 523 supplies the reference resistance control signal RCS for controlling the switches $SW_1$ to $SW_N$ of the reference resistance generation circuit 521. Specifically, according to the comparison result by the comparator 522, the circuit controller 523 changes the expected crack resistance range by changing a maximum value or a minimum value of the expected crack resistance range. A median value of the changed expected crack resistance range is calculated, and the reference resistance control signal RCS is supplied to the reference resistance generation circuit 521 such that the reference resistance Rref has the calculated median value of the expected crack resistance range.

Figure 5:
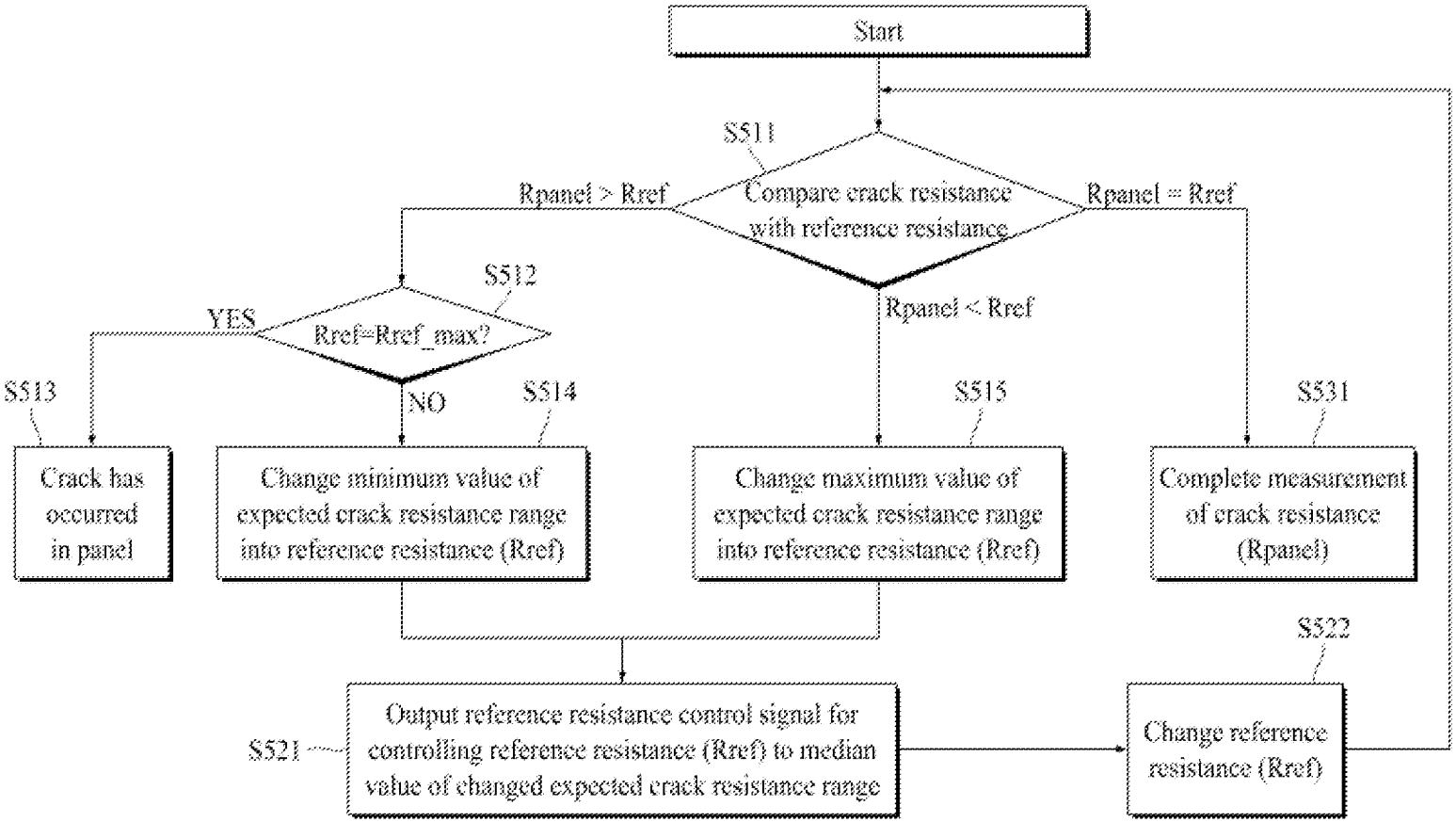
FIG. 5 is a flowchart of a method of measuring a crack of a display panel according to one embodiment of the present disclosure.
Figure 6:
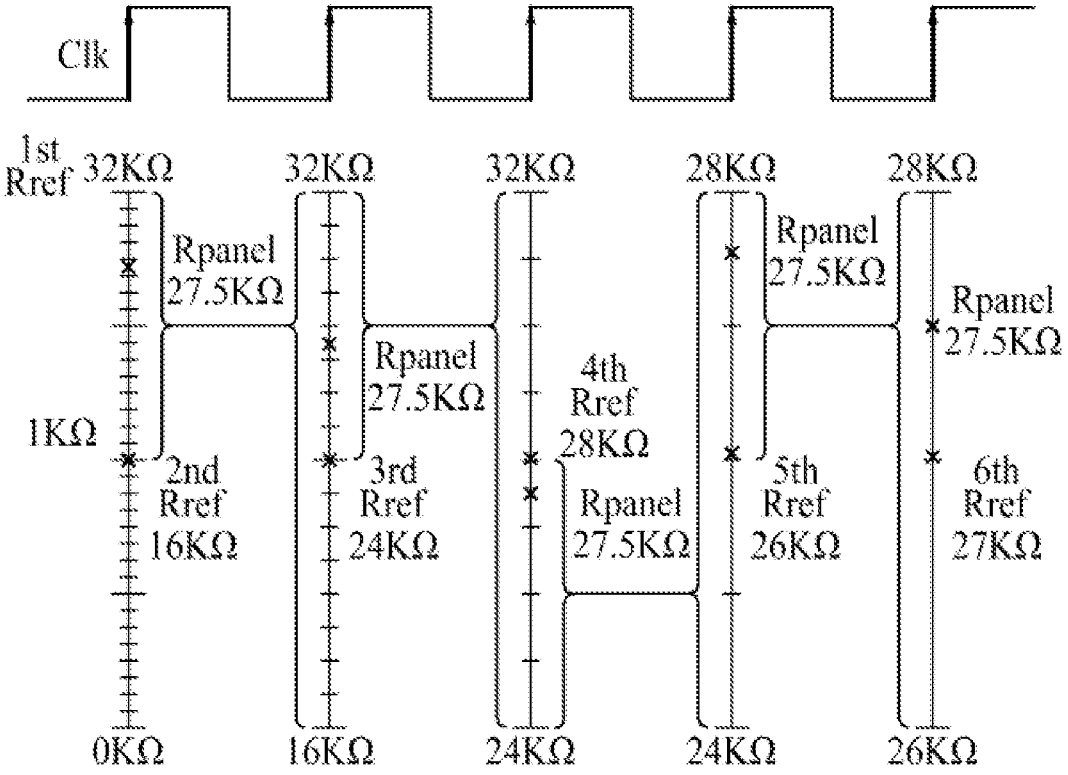
FIG. 6 is a diagram illustrating a method of measuring a crack resistance according to one embodiment of the present disclosure.

Hereinafter, a method of determining whether a crack occurs in a display panel according to one embodiment of the present disclosure will be described in detail with reference to FIGS. 5 and 6. FIG. 5 is a flowchart of a method of measuring a crack of a display panel according to one embodiment of the present disclosure, and FIG. 6 is a diagram illustrating a method of measuring a crack resistance according to one embodiment of the present disclosure.

According to one embodiment of the present disclosure, a circuit controller 523 receives a comparison result between a reference resistance Rref generated from a reference resistance generation circuit 521 and a crack resistance Rpanel of a display panel 100 from a comparator 522. The circuit controller 523 according to one embodiment of the present disclosure controls a magnitude of the reference resistance Rref by outputting a reference resistance control signal RCS for adjusting the magnitude of the reference resistance Rref according to the comparison result received from the comparator 522. Thereafter, such processes are repeated until the reference resistance Rref of the reference resistance generation circuit 521 has the same value as a resistance Rpanel of a panel crack measurement circuit, thereby controlling the magnitude of the reference resistance Rref of the reference resistance generation circuit 521 to measure a magnitude of the resistance Rpanel of the panel crack measurement circuit.

First, a crack resistance Rpanel is compared with the reference resistance Rref (S511). According to one embodiment of the present disclosure, the crack resistance Rpanel is compared with the reference resistance Rref according to a clock signal Clk output from a timing controller 300.

When the crack resistance Rpanel is greater than the reference resistance Rref, whether the reference resistance Rref has the same value as a maximum reference resistance Rref_max is determined (S512).

When the crack resistance Rpanel is greater than the reference resistance Rref and when the reference resistance Rref has the same value as the maximum reference resistance Rref_max, the circuit controller 523 determines that a crack has occurred in the display panel 100 (S513). Specifically, when the crack resistance Rpanel is greater than the reference resistance Rref and when the reference resistance Rref has the same value as the maximum reference resistance Rref_max, the circuit controller 523 determines that a crack resistance circuit is opened by the crack.

When the crack resistance Rpanel is greater than the reference resistance Rref and when the reference resistance Rref has a different value from the maximum reference resistance Rref_max, the circuit controller 523 changes a minimum value of an expected crack resistance range into the reference resistance Rref (S514). Specifically, when the crack resistance Rpanel is greater than the reference resistance Rref and when the reference resistance Rref has the different value from the maximum reference resistance Rref_max, the circuit controller 523 changes the minimum value of the expected crack resistance range into the reference resistance Rref so that the expected crack resistance range is also changed.

Thereafter, the circuit controller 523 outputs a reference resistance control signal RCS for controlling the reference resistance Rref to a median value of the changed expected crack resistance range (S521). Specifically, the circuit controller 523 calculates the median value of the changed expected crack resistance range and outputs the reference resistance control signal RCS for controlling the reference resistance Rref to the calculated median value of the expected crack resistance range to the reference resistance generation circuit 521.

Next, the reference resistance generation circuit 521 changes a value of the reference resistance Rref (S522). Specifically, the reference resistance generation circuit 521 controls first to $N^{th}$ switches $SW_1$ to $SW_N$ according to the received reference resistance control signal RCS to change the value of the reference resistance Rref.

On the other hand, when the crack resistance Rpanel is less than the reference resistance Rref, the circuit controller 523 changes a maximum value of the expected crack resistance range into the reference resistance Rref (S515). Specifically, when the crack resistance Rpanel is less than the reference resistance Rref, the circuit controller 523 changes the maximum value of the expected crack resistance range into the reference resistance Rref so that the expected crack resistance range is also changed.

Thereafter, the circuit controller 523 outputs the reference resistance control signal RCS for controlling the reference resistance Rref to a median value of the changed expected crack resistance range (S521). Specifically, the circuit controller 523 calculates the median value of the changed expected crack resistance range and outputs the reference resistance control signal RCS for controlling the reference resistance Rref to the calculated median value of the expected crack resistance range to the reference resistance generation circuit 521.

Next, the reference resistance generation circuit 521 changes a value of the reference resistance Rref (S522). Specifically, the reference resistance generation circuit 521 controls the first to $N^{th}$ switches $SW_1$ to $SW_N$ according to the received reference resistance control signal RCS to change the value of the reference resistance Rref.

According to one embodiment of the present disclosure, operations S511 to S522 are repeated until the crack resistance Rpanel has the same magnitude as the reference resistance Rref.

When the crack resistance Rpanel has the same value as the reference resistance Rref, the measurement of the crack resistance Rpanel is completed (S531).

TABLE 1

| Clk [period] | Rpanel [kΩ] | Expected crack resistance range [kΩ] | Value of expected crack resistance range [kΩ] | Rref [kΩ] | Comparator output [1: H, 0: L] |
|---|---|---|---|---|---|
| 1 | 27.5 | 0 to 32 | 32 | 32 | 0 |
| 2 | | 16 to 32 | 16 | 16 | 1 |
| 3 | | 24 to 32 | 8 | 24 | 1 |
| 4 | | 26 to 28 | 4 | 28 | 0 |
| 5 | | 26 to 28 | 2 | 26 | 1 |
| 6 | | 27 to 28 | 1 | 27 | 1 |

As shown in Table 1 and FIG. 6, when the crack resistance Rpanel is 27.5 kΩ, an example of a resistance measuring process will be described. When a rising edge of a first clock signal Clk occurs, the circuit controller 523 controls a first reference resistance $1^{st}$ Rref to the maximum value Rref_max of the reference resistance Rref. Accordingly, the comparator 522 compares the crack resistance Rpanel with the first reference resistance $1^{st}$ Rref having the maximum value Rref_max. That is, the first reference resistance $1^{st}$ Rref of the reference resistance generation circuit 521 has a maximum value of 32 kΩ, and the crack resistance Rpanel is compared with the first reference resistance $1^{st}$ Rref having the maximum value Rref_max of 32 kΩ. In this case, the circuit controller 523 receives a comparison result in which the crack resistance Rpanel is less than the first reference resistance $1^{st}$ Rref. Accordingly, the circuit controller 523 changes a maximum value of the expected crack resistance range into the first reference resistance $1^{st}$ Rref, calculates a median value of the expected crack resistance range, and outputs a signal for controlling a second reference resistance $2^{nd}$ Rref of the reference resistance generation circuit 521 to the median value of the expected crack resistance range. That is, the circuit controller 523 receives the comparison result in which the crack resistance Rpanel is less than the first reference resistance $1^{st}$ Rref of 32 kΩ and stores the current first reference resistance $1^{st}$ Rref of 32 kΩ as the maximum value of the expected crack resistance range. In addition, the circuit controller 523 calculates a median value (16 kΩ) of the expected crack resistance range and outputs the reference resistance control signal RCS such that the second reference resistance $2^{nd}$ Rref of the reference resistance generation circuit 521 has the median value (16 kΩ) of the expected crack resistance range (0 kΩ to 32 kΩ).

Next, when a rising edge of a second clock signal occurs, the crack resistance Rpanel is compared with the second reference resistance $2^{nd}$ Rref of the reference resistance generation circuit 521. That is, the crack resistance Rpanel is compared with the second reference resistance $2^{nd}$ Rref of 16 kΩ of the reference resistance generation circuit 521. In this case, the circuit controller 523 receives a comparison result in which the crack resistance Rpanel is greater than the second reference resistance $2^{nd}$ Rref. Accordingly, the circuit controller 523 changes a minimum value of the expected crack resistance range into the second reference resistance $2^{nd}$ Rref, calculates a median value (24 kΩ) of the expected crack resistance range, and outputs the reference resistance control signal RCS such that a third reference resistance $3^{rd}$ Rref of the reference resistance generation circuit 521 has the median value (24 kΩ) of the expected crack resistance range (16 kΩ to 32 kΩ).

Next, when a rising edge of a third clock signal occurs, the crack resistance Rpanel is compared with the third reference resistance $3^{rd}$ Rref of the reference resistance generation circuit 521. That is, the crack resistance Rpanel is compared with the third reference resistance $3^{rd}$ Rref of 24 kΩ of the reference resistance generation circuit 521. In this case, the circuit controller 523 receives a comparison result in which the crack resistance Rpanel is greater than the third reference resistance $3^{rd}$ Rref. Accordingly, the circuit controller 523 changes a minimum value of the expected crack resistance range into the third reference resistance $3^{rd}$ Rref, calculates a median value (28 kΩ) of the expected crack resistance range, and outputs the reference resistance control signal RCS such that a fourth reference resistance $4^{th}$ Rref of the reference resistance generation circuit 521 has the median value (28 kΩ) of the expected crack resistance range (24 kΩ to 32 kΩ).

Next, when a rising edge of a fourth clock signal occurs, the crack resistance Rpanel is compared with the fourth reference resistance $4^{th}$ Rref of the reference resistance generation circuit 521. That is, the crack resistance Rpanel is compared with the fourth reference resistance $4^{th}$ Rref of 28 kΩ of the reference resistance generation circuit 521. In this case, the circuit controller 523 receives a comparison result in which the crack resistance Rpanel is less than the fourth reference resistance $4^{th}$ Rref. Accordingly, the circuit controller 523 changes a maximum value of the expected crack resistance range into the fourth reference resistance $4^{th}$ Rref, calculates a median value (26 kΩ) of the expected crack resistance range, and outputs the reference resistance control signal RCS such that a fifth reference resistance $5^{th}$ Rref of the reference resistance generation circuit 521 has the median value (26 kΩ) of the expected crack resistance range (24 kΩ to 28 kΩ).

Next, when a rising edge of a fifth clock signal occurs, the crack resistance Rpanel is compared with the fifth reference resistance $5^{th}$ Rref of the reference resistance generation circuit 521. That is, the crack resistance Rpanel is compared with the fifth reference resistance $5^{th}$ Rref of 26 kΩ of the reference resistance generation circuit 521. In this case, the circuit controller 523 receives a comparison result in which the crack resistance Rpanel is greater than the fifth reference resistance $5^{th}$ Rref. Accordingly, the circuit controller 523 changes a minimum value of the expected crack resistance range into the fifth reference resistance $5^{th}$ Rref, calculates a median value of the expected crack resistance range, and outputs the reference resistance control signal RCS such that a sixth reference resistance $6^{th}$ Rref of the reference resistance generation circuit 521 has the median value (27 kΩ) of the expected crack resistance range (26 kΩ to 28 kΩ).

Next, although not shown, when a rising edge of a sixth clock signal occurs, the crack resistance Rpanel is compared with the sixth reference resistance $6^{th}$ Rref of the reference resistance generation circuit 521. That is, the crack resistance Rpanel is compared with the sixth reference resistance $6^{th}$ Rref of 27 kΩ of the reference resistance generation circuit 521. In this case, the circuit controller 523 receives a comparison result in which the crack resistance Rpanel is greater than the sixth reference resistance $6^{th}$ Rref. However, the crack resistance Rpanel of 27.5 kΩ is greater than the sixth reference resistance $6^{th}$ Rref of 27 kΩ by 0.5 kΩ, but a resolution of the reference resistance generation circuit 521 is 1 kΩ, and a value of the expected crack resistance range is the same as the resolution of the reference resistance generation circuit 521. Therefore, the circuit controller 523 may determine that the crack resistance Rpanel and the sixth reference resistance $6^{th}$ Rref have the same value.

Although not shown, according to the present disclosure, a value of the crack resistance Rpanel may be measured through such processes, and a degree of defect due to a crack occurring in a display panel can be determined using the measured value of the crack resistance Rpanel.

According to one embodiment of the present disclosure, the expected crack resistance range is reduced by half for every clock signal, and accordingly, a maximum time $t_{detect}$ required to measure the crack resistance Rpanel is calculated according to Equation 1.

$$t_{detect} = \log_2\left(\frac{\text{Range}}{\text{Resolution}}\right) \times t_{clk} \quad \text{[Equation 1]}$$

In this case, Range denotes a maximum value of the expected crack resistance range, Resolution denotes a resolution of the reference resistance generation circuit 521, and $t_{clk}$ denotes a period of a clock signal output from the timing controller 300.

According to the present disclosure, since a crack resistance is measured according to a clock signal, it is possible to quickly measure the crack resistance.

According to a display device including a crack resistance measurement circuit and a method of measuring a crack of a display panel according to the present disclosure, a crack resistance of a display panel can be measured, thereby determining defects of the display panel due to a crack through a value of the measured crack resistance.

In addition, according to a display device including a crack resistance measurement circuit and a method of measuring a crack of a display panel according to the present disclosure, a resolution of a crack resistance measurement circuit can be improved, thereby measuring a crack resistance more accurately.

Furthermore, according to a display device including a crack resistance measurement circuit and a method of measuring a crack of a display panel according to the present disclosure, since a crack resistance is measured according to a clock signal, it is possible to quickly measure the crack resistance.

It will be apparent to those skilled in the art that various changes and modifications may be made without departing from the spirit and scope of the disclosure.

In addition, at least a part of the methods described herein may be implemented using one or more computer programs or components. These components may be provided as a series of computer instructions through a computer-readable medium or a machine-readable medium, which includes volatile and non-volatile memories. The instructions may be provided as software or firmware and may be entirely or partially implemented in a hardware configuration such as application specific integrated circuits (ASICs), field programmable gate arrays (FPGAs), digital signal processors (DSPs), or other similar devices. The instructions may be configured to be executed by one or more processors or other hardware components, and when one or more processors or other hardware components execute the series of computer instructions, one or more processors or other hardware components may entirely or partially perform the methods and procedures disclosed herein.

Therefore, the above-described embodiments should be understood to be exemplary and not limiting in every aspect. The scope of the present disclosure will be defined by the following claims rather than the above-detailed description, and all changes and modifications derived from the meaning and the scope of the claims and equivalents thereof should be understood as being included in the scope of the present disclosure.

What is claimed is:

1. A display driver which includes a crack resistance measurement circuit connected to a crack resistance circuit of a display panel to measure a crack resistance of the crack resistance circuit, wherein the crack resistance measurement circuit includes:

a reference resistance generation circuit configured to generate a reference resistance using at least two resistors connected in series and at least two switches connected to correspond to the at least two resistors;

a comparator configured to compare a magnitude of the crack resistance with a magnitude of the reference resistance and output a resistance comparison result; and a circuit controller configured to output a reference resistance control signal for controlling the at least two switches according to the resistance comparison result.

2. The display driver of claim 1, wherein:

the at least two resistors are connected in series between an input node and an output node; and the at least two switches are each connected to a corresponding one of the resistors in parallel between the input node and the output node.

3. The display driver of claim 1, wherein:

the at least two switches are turned on or off according to the reference resistance control signal output from the circuit controller; and the reference resistance is controlled according to the at least two switches.

4. The display driver of claim 1, wherein the at least two resistors have the same resistance.

5. The display driver of claim 4, wherein the reference resistance generation circuit has the same resolution as a resistance of the resistor.

6. The display driver of claim 1, wherein the comparator compares the magnitude of the crack resistance with the magnitude of the reference resistance according to a clock signal input from a timing controller.

7. The display driver of claim 1, wherein the circuit controller changes a maximum value or a minimum value of an expected crack resistance range according to the resistance comparison result and outputs the reference resistance control signal for controlling the reference resistance to be a median value of the changed expected crack resistance range.

8. The display driver of claim 7, wherein a value of the expected crack resistance range is reduced by half whenever a clock signal is output from the timing controller.

9. The display driver of claim 7, wherein:

the circuit controller compares the reference resistance with a maximum reference resistance when the crack resistance is greater than the reference resistance and determines that a crack has occurred in the display panel when the reference resistance is the same as the maximum reference resistance;

the circuit controller compares the reference resistance with the maximum reference resistance when the crack resistance is greater than the reference resistance and changes the minimum value of the expected crack resistance range into the reference resistance when the reference resistance is different from the maximum reference resistance; and the circuit controller changes the maximum value of the expected crack resistance range into the reference resistance when the crack resistance is less than the reference resistance.

10. A display driver, comprising:

a crack resistance measurement circuit which is connected to a crack resistance circuit of a display panel, and is configured to measure a crack resistance of the crack resistance circuit to determine whether a crack has occurred in the display panel; and a timing controller configured to output a clock signal to the crack resistance measurement circuit, wherein the crack resistance measurement circuit is configured to compare a magnitude of the crack resistance with a magnitude of a reference resistance according to the clock signal and measure the crack resistance of the crack resistance circuit based on a resistance comparison result, wherein the crack resistance measurement circuit includes:

a reference resistance generation circuit configured to generate the reference resistance;

a comparator configured to compare the magnitude of the crack resistance with the magnitude of the reference resistance; and a circuit controller configured to determine that the crack has occurred in the display panel based on the resistance comparison result or output a reference resistance control signal for controlling the magnitude of the reference resistance to the reference resistance generation circuit, wherein the circuit controller compares the reference resistance with a maximum reference resistance when the crack resistance is greater than the reference resistance and determines that the crack has occurred in the display panel when the reference resistance is equal to the maximum reference resistance.

11. The display driver of claim 10, wherein:

the circuit controller compares the reference resistance with a maximum reference resistance when the crack resistance is greater than the reference resistance and changes a minimum value of an expected crack resistance range into the reference resistance when the reference resistance is different from the maximum reference resistance; and the circuit controller changes a maximum value of the expected crack resistance range into the reference resistance when the crack resistance is less than the reference resistance and outputs the reference resistance control signal for controlling the reference resistance to be changed into a median value of the changed expected crack resistance range to the reference resistance generation circuit.

12. The display driver of claim 11, wherein a value of the expected crack resistance range is reduced by half whenever the clock signal is output from the timing controller.

13. A display driver comprising a crack resistance measurement circuit configured to measure a magnitude of a crack resistance, wherein the crack resistance measurement circuit includes:

a reference resistance generation circuit configured to generate a reference resistance using at least two resistors connected in series and at least two switches connected to correspond to the at least two resistors;

a comparator configured to compare the magnitude of the crack resistance with a magnitude of the reference resistance and output a resistance comparison result; and a circuit controller configured to output a reference resistance control signal for controlling the at least two switches according to the resistance comparison result.

14. The display driver of claim 13, wherein:

the at least two resistors are connected in series between an input node and an output node; and the at least two switches are each connected to a corresponding one of the resistors in parallel between the input node and the output node.

15. The display driver of claim 13, wherein:

the at least two switches are turned on or off according to the reference resistance control signal output from the circuit controller; and the reference resistance is controlled according to the at least two switches.

16. The display driver of claim 13, wherein the at least two resistors have the same resistance.

17. The display driver of claim 13, wherein the comparator compares the magnitude of the crack resistance with the magnitude of the reference resistance according to a clock signal input from a timing controller.

18. The display driver of claim 13, wherein the circuit controller changes a maximum value or a minimum value of an expected crack resistance range according to the resistance comparison result and outputs the reference resistance control signal for controlling the reference resistance to be a median value of the changed expected crack resistance range to the reference resistance generation circuit.

* * * * *